United States Patent [19]

Fagan

[11] 4,065,911

[45] Jan. 3, 1978

[54] BACONWEIGHER

[75] Inventor: John C. Fagan, Oak Lawn, Ill.

[73] Assignee: Amtron, Division of the Sippican Corporation, Midlothian, Ill.

[21] Appl. No.: 704,331

[22] Filed: July 12, 1976

[51] Int. Cl.[2] ..... B26D 4/56

[52] U.S. Cl. ..... 53/53; 53/59 W; 53/59 R; 53/123; 83/61; 83/73; 83/77

[58] Field of Search ..... 83/61, 73, 77; 53/53, 53/123, 59 W, 59 R

[56] References Cited

U.S. PATENT DOCUMENTS

| | | | |
|---|---|---|---|
| 3,379,234 | 4/1968 | Kasper | 83/77 X |
| 3,605,837 | 9/1972 | Lambert et al. | 83/73 |
| 3,667,520 | 6/1972 | Flesch | 83/73 |
| 3,827,319 | 8/1974 | Flesch | 83/73 |
| 3,846,958 | 11/1974 | Divan | 83/77 X |

*Primary Examiner*—J. M. Meister
*Attorney, Agent, or Firm*—Kane, Dalsimer, Kane, Sullivan and Kurucz

[57] ABSTRACT

A combination bacon slicing, segregating and weighing machine is provided. The slicing machine has a slicing blade and controls for determining the rate of feed of the bacon belly towards the slicing blade and, consequently, the slice thickness. Receiving and conveying structure is associated with the weighing machine and receives the sliced product coming from the slicing machine. Control apparatus is designed for interruption of the operation of the feeding mechanism by appropriate controls when the slices are at a weight less than the prescribed draft weight. The apparatus then provides for weighing and registering the weight of the accumulated light weight group of sliced product and for counting the number of slices in the lighter group. The apparatus calculates by subtracting the weight of the group from a heavier draft target weight and multiplying the weight difference by the ratio of the slices in the lighter group to the weight of the lighter group to determine the number of slices to be added to produce the target weight without changing the slice thickness. The number of slices required for the target weight rounded out to the nearest whole integer is then calculated. Thereafter, the error produced by rounding off to the nearest whole integer is corrected by multiplying the first feed rate by the ratio of the number of slices calculated to produce the target weight by the number of slices rounded off to the nearest integer to provide a new feed rate which will produce a number of whole slices at the right thickness in making up the added weight to produce the draft target weight.

10 Claims, 13 Drawing Figures

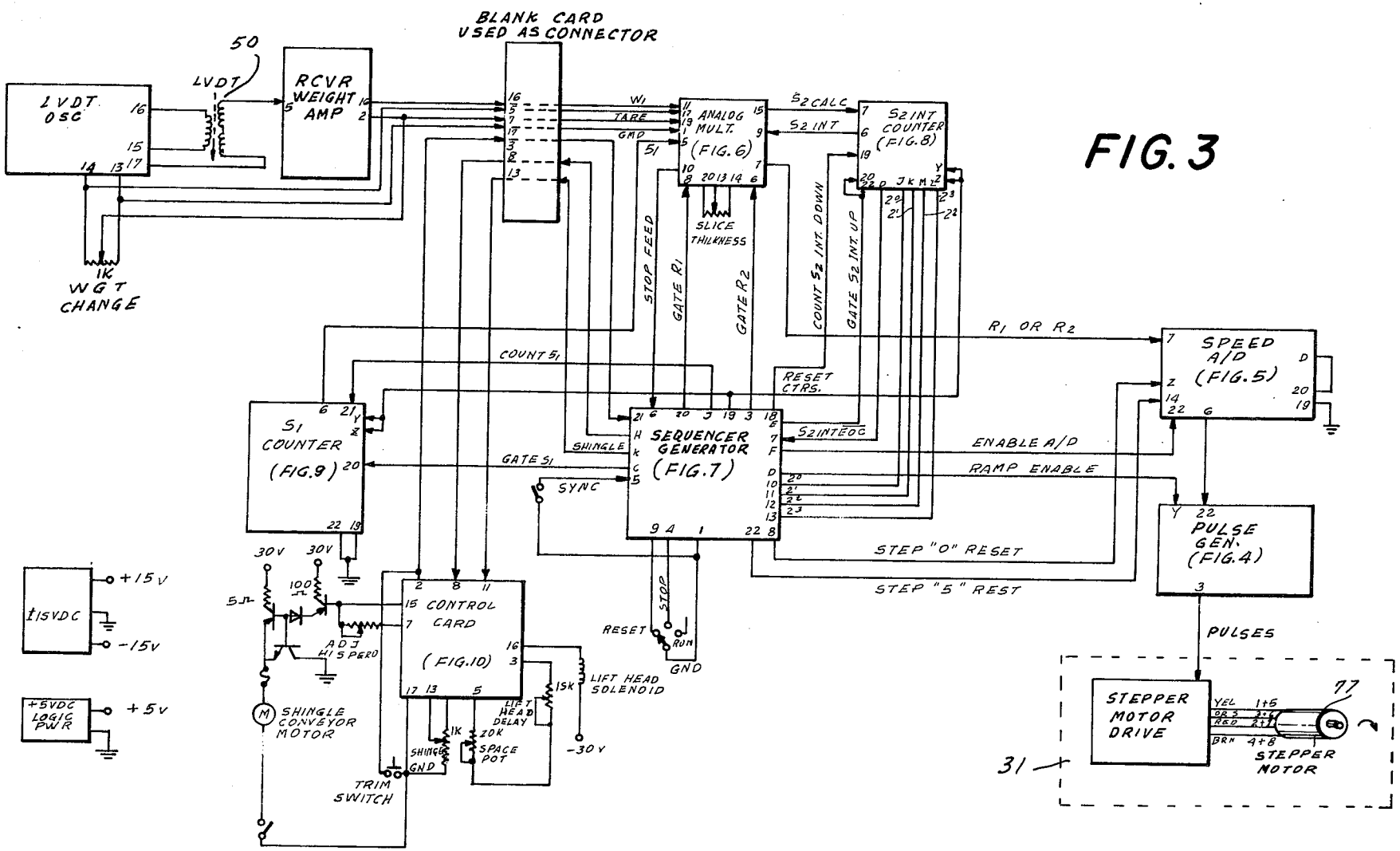
FIG. 3
SPEED A/D (FIG.5)
PULSE GEN. (FIG.4)
PULSES
STEPPER MOTOR
STEPPER MOTOR DRIVE
31
R1 OR R2
ENABLE A/D
RAMP ENABLE
STEP "0" RESET
STEP "5" REST
S2 INT COUNTER (FIG.8)
GATE S2 INT UP
COUNT S2 INT DOWN
RESET CTRS.
S2 INTEOG
S2 CALC
S2 INT
ANALOG MULT. (FIG.6)
SLICE THICKNESS
GATE R2
GATE R1
STOP FEED
SEQUENCER GENERATOR (FIG.7)
RUN
STOP
GND
RESET
SYNC
SHINGLE
COUNT S1
GATE S1
BLANK CARD USED AS CONNECTOR
W1
TARE
GND
S1
LIFT HEAD SOLENOID
-30 V
15K
LIFT HEAD DELAY
SPACE POT
20K
1K
SHINGLE GND
CONTROL CARD (FIG.10)
TRIM SWITCH
S1 COUNTER (FIG.9)
ADJ HI SPEED
30V
100Ω
5Ω
SHINGLE CONVEYOR MOTOR
RCVR WEIGHT AMP
50
LVDT
LVDT OSC
1K WGT CHANGE
±15VDC
+15 V
-15V
+5 V
+5VDC LOGIC PWR

BACONWEIGHER

BACKGROUND OF THE INVENTION

The present invention relates to improvements in apparatus for slicing bacon and arranging the slices in shingled form with controlled weight. Apparatus of this type is being marketed by Cashin Systems Corp., Williston Park, New York, and is disclosed in commonly assigned U.S. Pat. Nos. 2,903,032 granted Sept. 8, 1959; 2,969,099 granted Jan. 24, 1961; 3,027,924 granted Apr. 3, 1962; 3,846,957 granted Nov. 12, 1974; and 3,846,958 granted Nov. 12, 1974. While this apparatus has proven to be eminently satisfactory, it is desirable to upgrade its operation and efficiency in an effort to further reduce give-away weights of bacon being sliced and minimize the time attendant personnel are required to expend in making proper weights of drafts not within the prescribed weight tolerances.

Heretofore, it has been proposed in U.S. Pat. Nos. 3,379,233 and 3,379,234 to upgrade the yield of a bacon slicing line by providing a system in which the product feed was stopped at some weight less than the final desired or target weight of the bacon draft or group weight. An error voltage was derived proportional to the amount of product required to meet the target weight and a second feeding cycle was initiated for a prescribed time period required to add the calculated amount of product.

Although this prior art system offered advantages, there nevertheless remained a need to further improve the pass percentage of bacon drafts falling within prescribed weight tolerances and consequently reduce labor costs in correcting weights outside of these tolerances.

SUMMARY OF THE INVENTION

Accordingly, it is a principal object of the present invention to significantly improve the pass percentage of bacon drafts falling within prescribed weight tolerances and consequently reduce labor costs in correct weights outside of these tolerances.

A further objective is to achieve a superiorly improved system over that disclosed in U.S. Pat. Nos. 3,379,233 and 3,379,234 in that the present improved system differs from the method of these patents in three principal ways:

a. the product calculated for add-on during the second feed is calculated directly in number of slices, and is a function of the average slice weight of the first feed;

b. the feed speed of the product for the second feed is automatically adjusted so that an integer number of slices (no partial slices) are added to make the required package weight; and c. the second feed is distributed over a number of slices, e.g. four, in order to minimize the deviation in slice thickness between the slices of the first and second feed.

Other objects and advantages will become apparent from the following detailed description which is to be taken in conjunction with the accompanying drawings.

BRIEF DESCRIPTION OF THE DRAWINGS

In the drawings:

FIG. 3 is a schematic block diagram showing the interconnections of the control circuitry;

DESCRIPTION OF THE PREFERRED EMBODIMENT

Figure 1A:
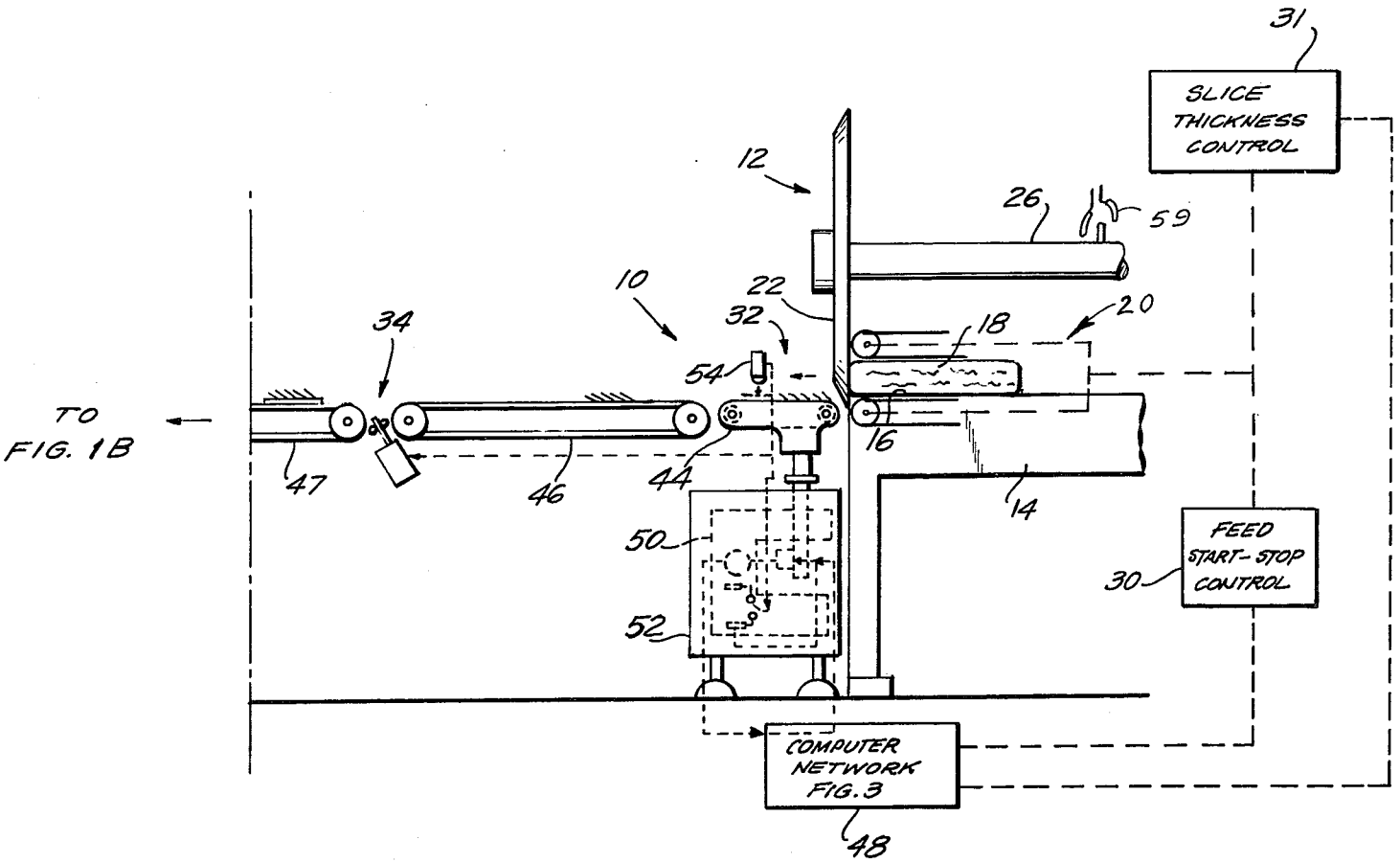
FIGS. 1A and 1B are fragmentary side elevational views of the apparatus of the present invention for slicing, weighing and grouping sliced food products.
Figure 1B:
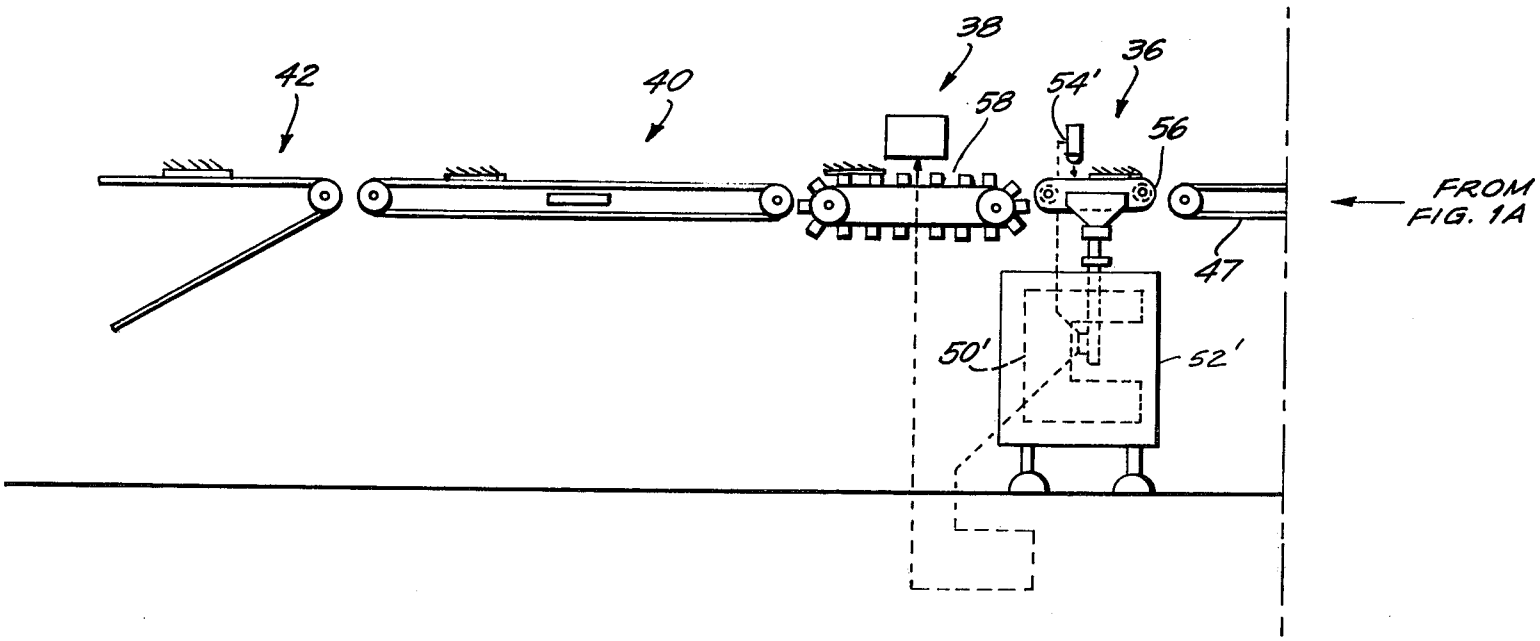
Figure 2A:
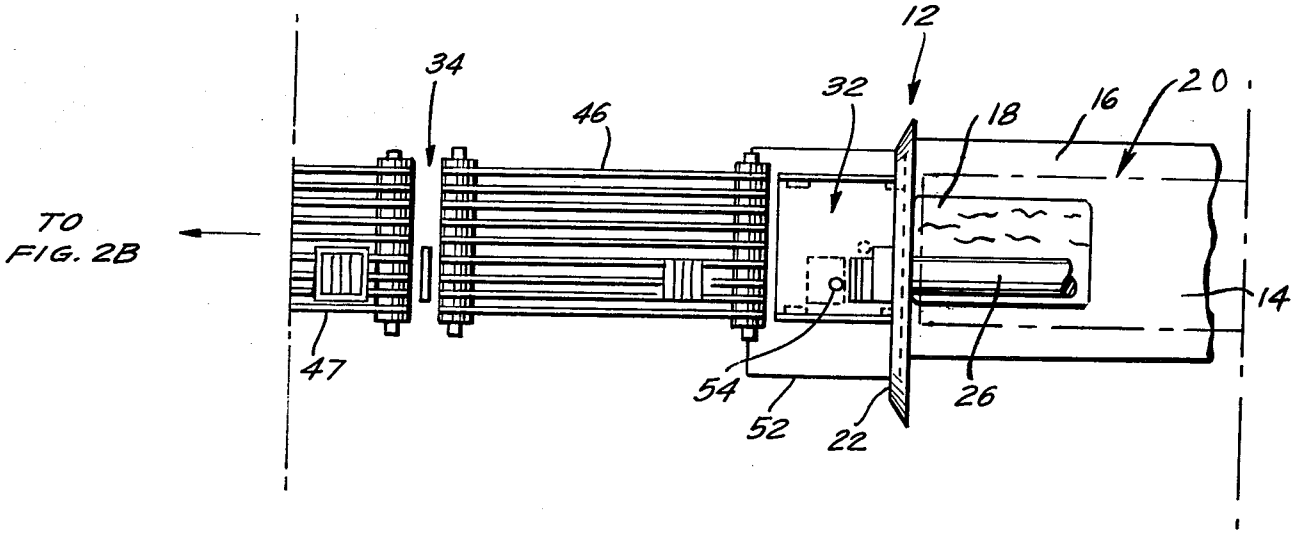
FIGS. 2A and 2B are top plan views thereof.
Figure 2B:
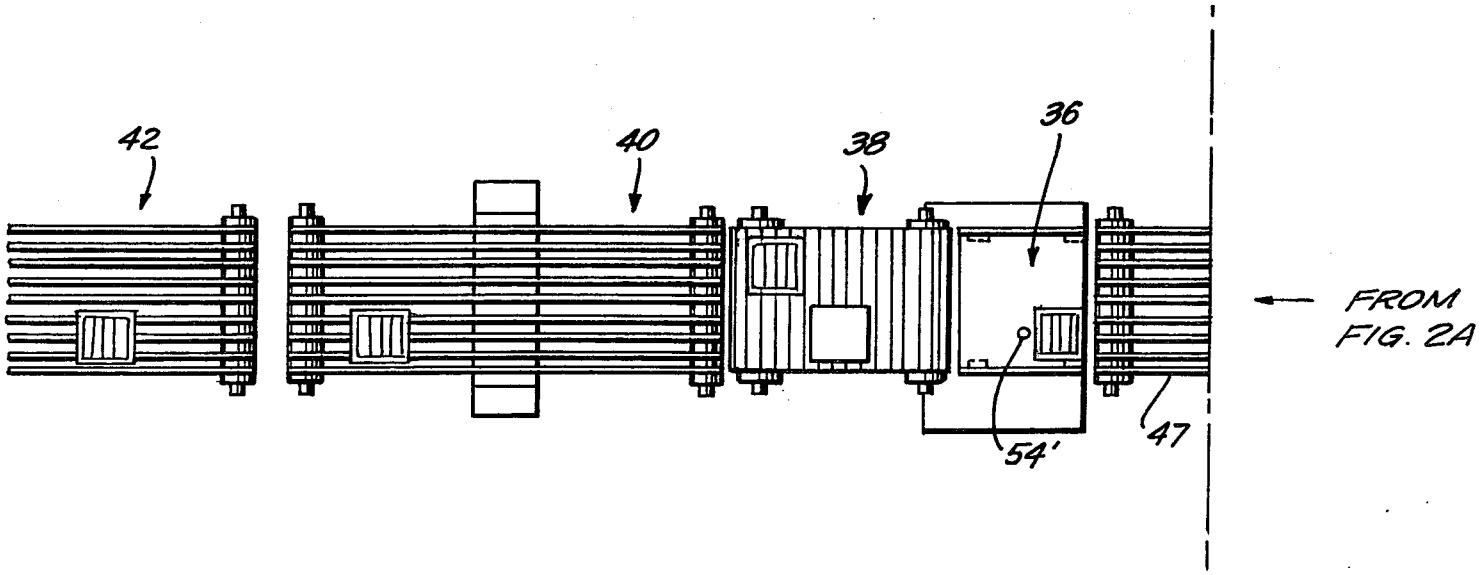
Figure 4:
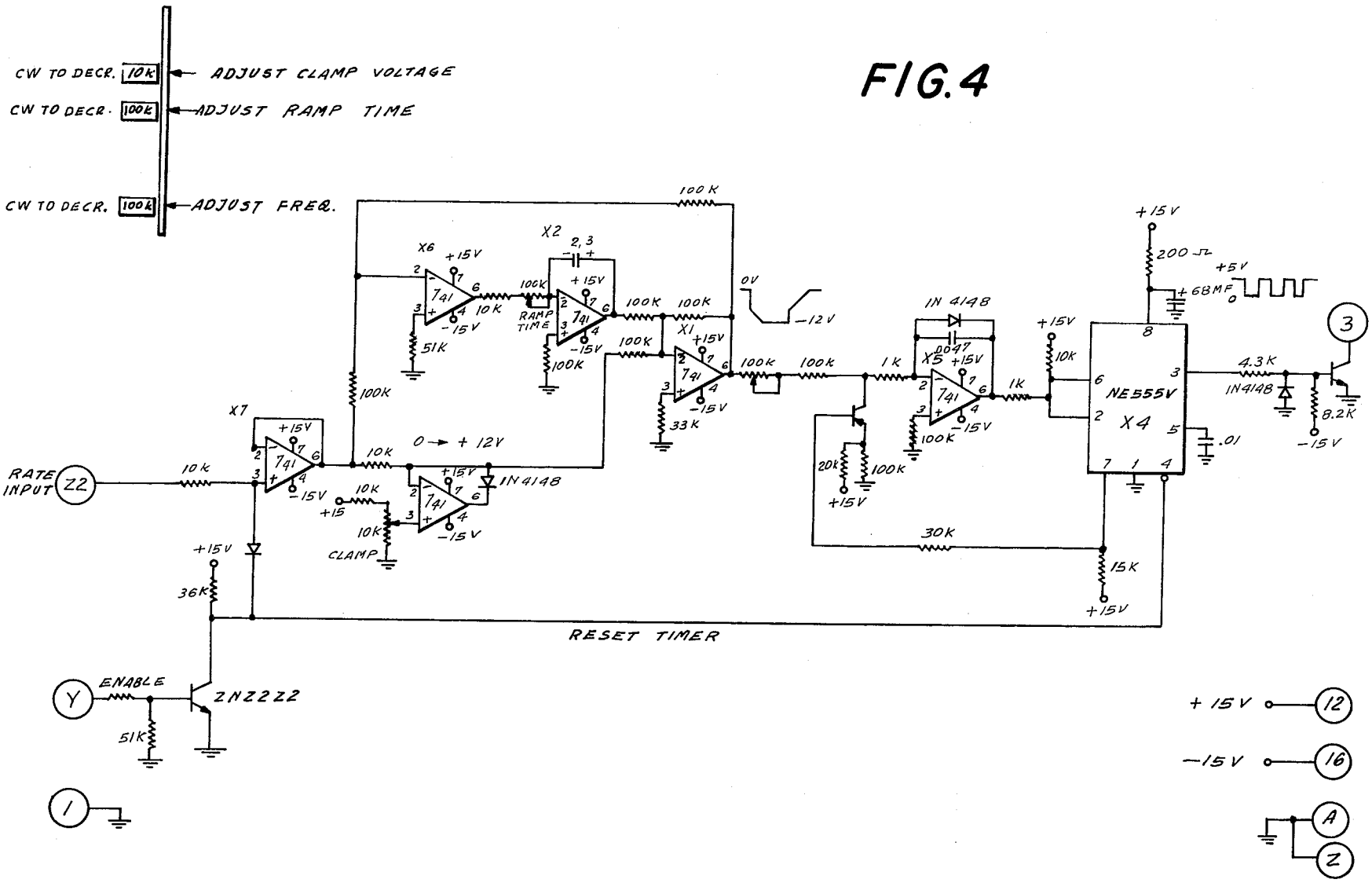
FIGS. 4 – 10 when assembled constitute the schematic of the control circuit depicted in FIG. 3.

The illustrated slicing machine 12 to which the present system is particularly applicable is one of a number usable in this invention. Thus, slicing machine 12 may assume the form disclosed in the aforementioned patents or may be the slicing machine available commercially under the Hydro-Matic slicer which is fully disclosed in the operating instructions for the ANCO No. 827 or 827C Hydro-Matic Bacon Slicer available from the manufacturer, the Allbright-Nell Company of Chicago, Ill. However, it is preferred that the slicing machine 12 be of the continuous feed type well known in the art as depicted generally in U.S. Pat. Nos. 3,354,920 granted Nov. 28, 1967 or 3,880,035 granted Apr. 29, 1975. For this reason, the slicing machine 12 will not be described in detail and for a more complete explanation thereof, reference should be made to the foregoing references.

Suffice it to state, the slicing machine 12 comprises a supporting table 14 having a platen or feed bed 16 over which the product, particularly bacon, shown at 18, is fed by a feeder or pusher 20 to the slicing blade 22. The bacon is sliced by the blade 22 and then discharged onto the measuring and segregating apparatus 10. Normally the forward or leading edge of the product 18 is pressed downwardly against the bed 16 so as to properly engage the blade 22. This may be accomplished by means of a spring pressure plate (not shown) suitably supported adjacent the blade 22. This blade is also encased in a housing (not shown) which serves to protect the operator and also prevents the particles of sliced product from being thrown outwardly from the blade by centrifugal force. In the identified commercially available slicing machines the blade 22 is rotated and is in the form of an eccentric or involute disc which revolves at relatively high speeds. The portion of the blade 22 having the greatest radius serves to slice the edge of the product 18 with the portion of the blade having a minimum radius providing clearance for the product to be fed outwardly thereby permitting the initiation of the next slicing cycle.

Product 18 is continuously fed forward by a continuously moving feed or conveyor mechanism shown generally as a conveyor 20 for simplicity of illustration and description. The belly feed mechanism or slice thickness control 31 may be of the type disclosed in the above referenced, commonly assigned patents. A slice thickness control 31 is provided for increasing or decreasing the rate of travel of the conveyor 20 to consequently increase and decrease the slice thickness, respectively. When the conveyor 20 feeds the product 18 forwardly at a relatively high rate of speed, the thickness of the slices increases, and when it operates at a relatively low rate of speed the thickness of the slice is reduced.

The blade 22 is mounted at the end of a rotatable shaft 26 and this shaft in turn may be driven by mechanism of the type disclosed in the above references.

The measuring and segregating apparatus 10 is adapted to receive the slices from the machine 12 and arrange them in shingled fashion and segregate them into groups of drafts of predetermined weight. This is accomplished by momentarily interrupting the feeding of the product 18 when this weight is obtained in order to obtain the desired spacing between groups. The drafts are placed on a sheet of cardboard and thereafter permitted to pass if within the accepted weight tolerance or rejected if not. Toward this end, the measuring and segregating apparatus 10 includes a bacon weighing station 32, a cardboard dispensing station 34, a check weighing station 36, a rejecting station 38, a make weigh station 40 and a take-away station 42.

The bacon weighing station 32 is adapted to receive the slices from the slicing machine, arrange them in shingled form and segregate one group draft of shingle slices from the next in a manner to be described in detail shortly. In this connection, the leading end of a relatively high speed weighing conveyor 44 is positioned adjacent the discharge end of the slicing machine in order that the formed slices are shingled as a result of the continuous movement of conveyor 44. When a predetermined weight of slices is accumulated on the weighing conveyor 44 they are transferred to the cardboard dispensing station 34 by band conveyor 46 and thereafter to check weighing station 36 by band conveyor 47. The computer network 48 shown in detail in FIG. 3 is coupled between the scale 50 and the feed start-stop control 30 and stepper motor 77 (FIG. 3) of slice thickness control 31.

The weighing conveyor 44 is supported by scale 50 which is disposed within the scale cabinet 52. The conveyor 44 may be of the adjustable variety as disclosed in U.S. Pat. No. 2,969,099 to accommodate one half pound shingle units as well as 1 pound shingle units. In addition, the conveyor 44 may be of the type disclosed in U.S. Pat. No. 3,200,864 which travels at a low speed during the depositing of slices thereon and at an increased speed after the weight is registered thereon by scale 50 to remove the drafts therefrom in a minimum period of time.

The automatic cardboard dispenser 34 may assume one of many known forms. It may be manual or automatically actuated when the shingled group of slices are detected by the detector 54. The dispenser 34 may be actuated by the mere act of weighing by the scale 50. As disclosed in detail in U.S. Pat. Nos. 3,405,504 granted Oct. 15, 1968 and 3,455,083 granted July 15, 1969, the detected group of slices is automatically deposited onto a card when this card is sensed travelling on the conveyor 44 by the detector 54. When this occurs, a card is pushed over a support into the pinch point of feed rollers following a suitable time delay. The rollers feed the card onto the conveyor 48 where the slices are discharged onto the card by the conveyor 46. Thereafter, another card is fed from a magazine and tucked into the pinch point of feed rollers which feed the card onto the support.

At the check weighing station 36, a constantly driven conveyor 56 receives the grouped, shingled slices travelling on conveyor 46. A suitable sensing means such as a photo-electric detector assembly 54' actuates the scale 50' which registers the weight of the group of slices on conveyor 56. If the scale as travelling thereon detects a group of slices which are underweight or outside of the prescribed weight tolerance, a signal is generated and transmitted to the reject station 38 in order that this group may be diverted for addition of the proper weight.

Should for any reason a group of slices transferred to the reject station 38 on a card be outside of the prescribed weight tolerance as sensed by scale 50', a reject mechanism will divert this group in a manner disclosed in U.S. Pat. No. 3,200,864. In this connection, a reject mechanism 58 is actuated to divert the appropriate draft. This group will then be brought within the limits of proper weight at the make weigh station 40. This adjusted weighed group, as well as the groups which fall within the prescribed weight tolerances, would be permitted to pass onto the take-away conveyor 42 to the appropriate packaging station (not shown).

In the illustrated embodiment, the position of the rotary cutting blade 22 is detected by a pair of transducers 59 each of which preferably includes a fixedly mounted glass reed switch having a pair of normally open contacts that are closed by a magnetic switch actuating element that is secured to the driven shaft 26 associated with the cutting blade 22. One of the glass reed switches is located so that the contacts of the glass reed switch are transiently closed at a time when the rotary cutting blade is positioned so that it is appropriate to advance the product feed conveyor and accordingly the bacon slab and thereby initiate a slicing operation. The glass reed switch of the other transducer 59 is situated so that the contacts thereof are transiently closed when the rotary cutting blade is in a position whereat a complete slice has just been removed from the bacon slab (i.e. a time when it would be appropriate to render the product weight conveyor transiently ineffective during an operating cycle). The slice count for operating counter of computer network 48 is conveniently taken off one of these reed switches in a manner well known to the art.

The bacon weighing station 32 will now be described in detail. At the beginning of each draft formation cycle, bacon will be sliced at an operator selected thickness until a certain portion, for example, about $\frac{3}{4}$ of a draft (i.e. 12 oz. for a 1 lb. package ) has been sliced and then the slice formation is stopped by stopping the feeding conveyor 20. After the feed stops, the scale 50 is allowed to settle until a stable weight reading can be obtained. This weight reading is referred to as a "$W_1$" in the following formula.

The number of slices contained in this first light weight group are also counted and are referred to as "$S_1$" in the formula.

Subtracting the weight of the first light weight group from the target weight of the draft K (16 oz.) gives the weight which must be added to produce an exact weight draft.

Multiplying this difference ($K-W_1$) by the slices per ounce $S_1/W_2$ gives the number of slices which must be added to produce an exact weight draft if the slice thickness (i.e. feed rate) remained the same.

Therefore, $S_2$ CALCULATED ($S_2$ CALC) = $(S_1/W_1)$ $(K - W_1)$. This calculation will no doubt include a partial slice and since fractional slices are not desired, the $S_2$ CALC. is rounded out to the nearest whole or integer number called $S_2$ INT.

Depending on how this number was rounded out, if this whole number of slices were added at the same feed rate, it would produce a light or heavy package.

To eliminate this error, the first feed rate ($R_1$) is multiplied by the ratio of ($S_2$ CALC./$S_2$ INT.) to give a new feed rate ($R_2$) which will produce a whole number of slices at the right thickness to give an exact weight package.

Therefore $$R_2 = (S_2\,\text{CALC}/S_2\,\text{INT}) \times R_1$$

The difference between $S_2$ CALC and $S_2$ INT is distributed evenly over the total number of slices to be added, and therefore, the variation in slice thickness between the first and second feed is minimized.

As in the above referred prior art bacon slicing equipment, the conveyor 20 stops after the added slices have been formed to cause the selected spacing between drafts to take place. Then the next draft slicing cycle commences at the first feed rate ($R_1$). All digital signals are first converted to analog voltages by D/A converters and applied to the analog computer circuitry depicted in FIG. 6, where most of the above computations are performed. A study of the circuitry of FIG. 5 will allow a more detailed understanding of the system concept.

A DC voltage proportional to the scale reading is received on pin 11 from a standard bacon weigher or scale 50 (as in the above identified references) and is converted to the proper level by amplifiers 62 and 64 to obtain a voltage vs. weight curve of 0.625V/oz.

A front panel control 66 (WGT POTENTIOMETER) provides a DC voltage on pin 19 which subtracts from the weight reading to compensate for scrap build-up on the scale conveyor 44.

The corrected $W_1$ weight reading is compared with a variable reference selected by resistor 70 to determine when to stop the first feed. This is normally set for 7.5V or 12 oz.

The computation $S_2 \text{CALC} = (S_1/W_1)(K - W_1)$ is performed by IC chip 72 which is an analog multiplier - divider. The value of K is selected by resistor 74 and is normally set to +10V which corresponds to 16 oz.

Figure 8:
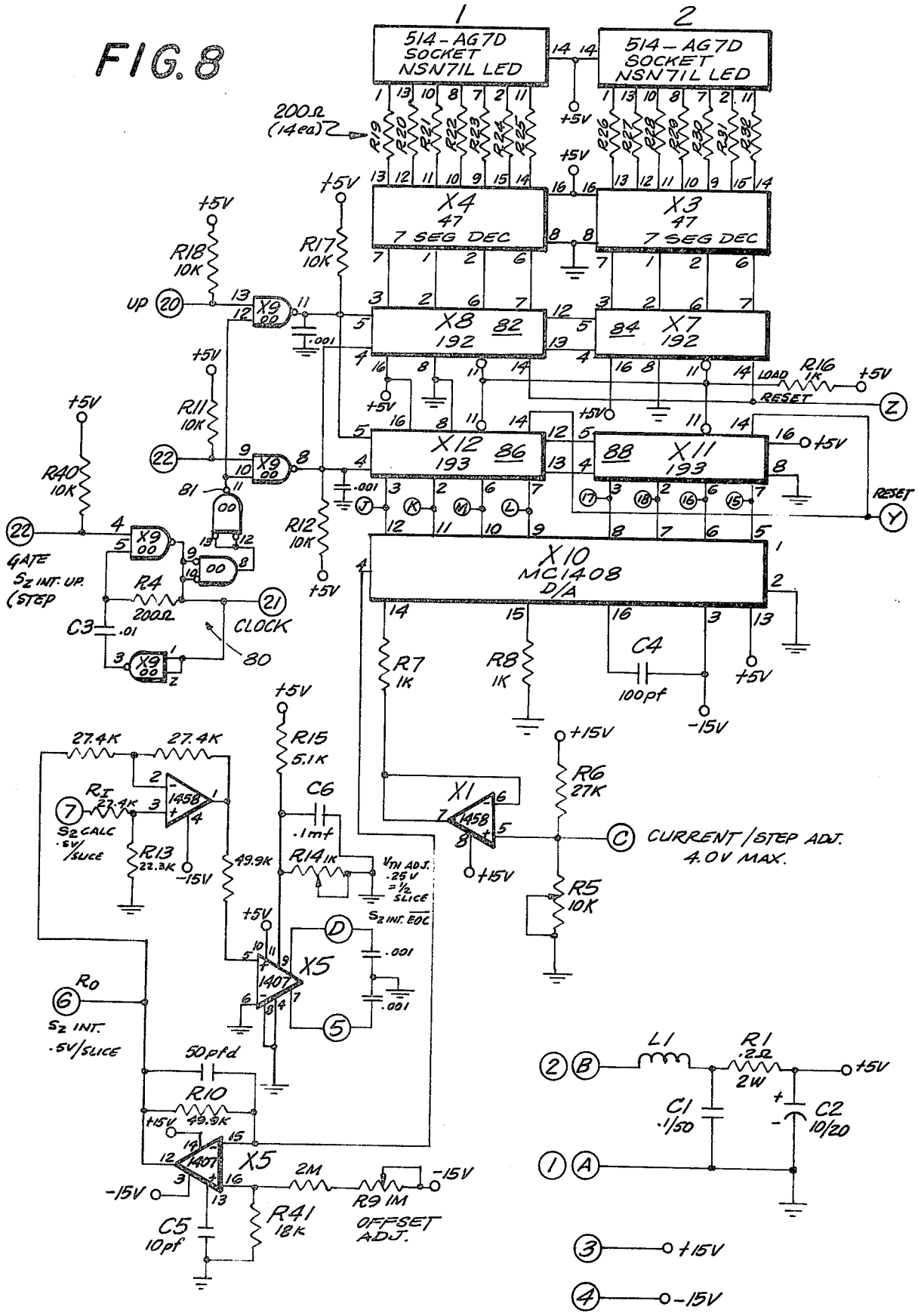
Figure 9:
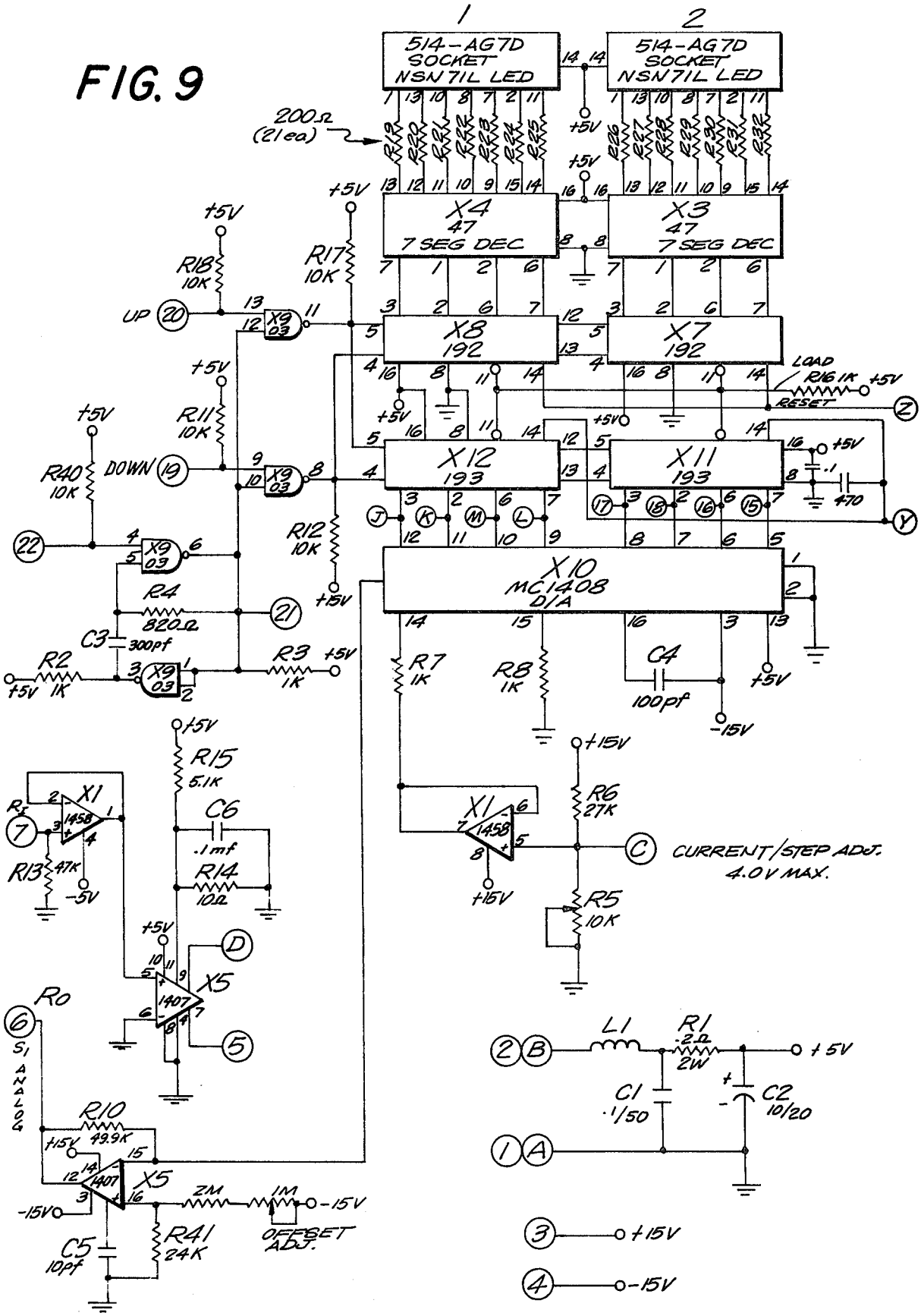
Figure 10:
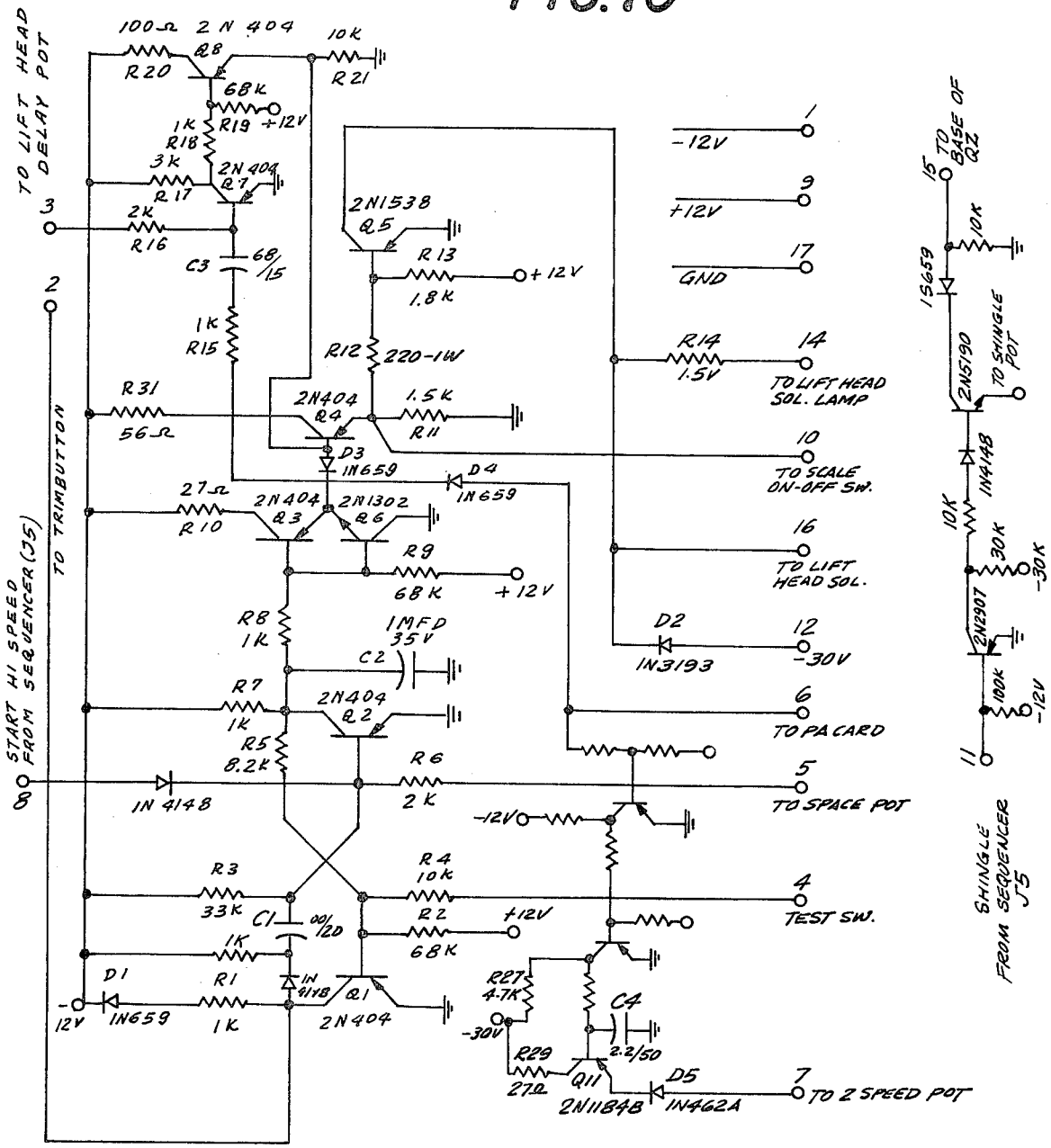

An analog voltage representing $S_1$ is received on pin 5 from the $S_1$ counter and D/A converter of FIG. 8.

Figure 7A:
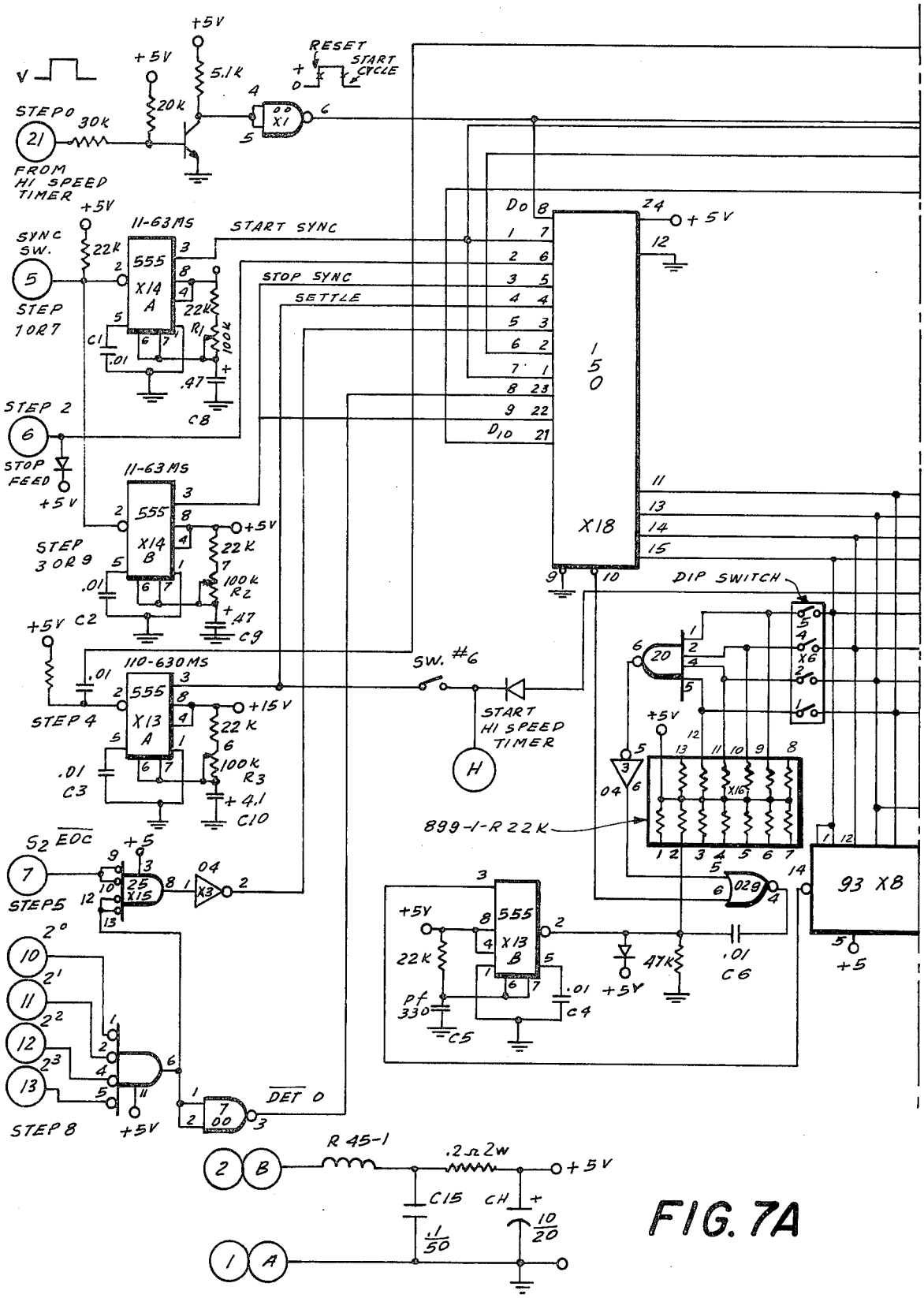
Figure 7B:
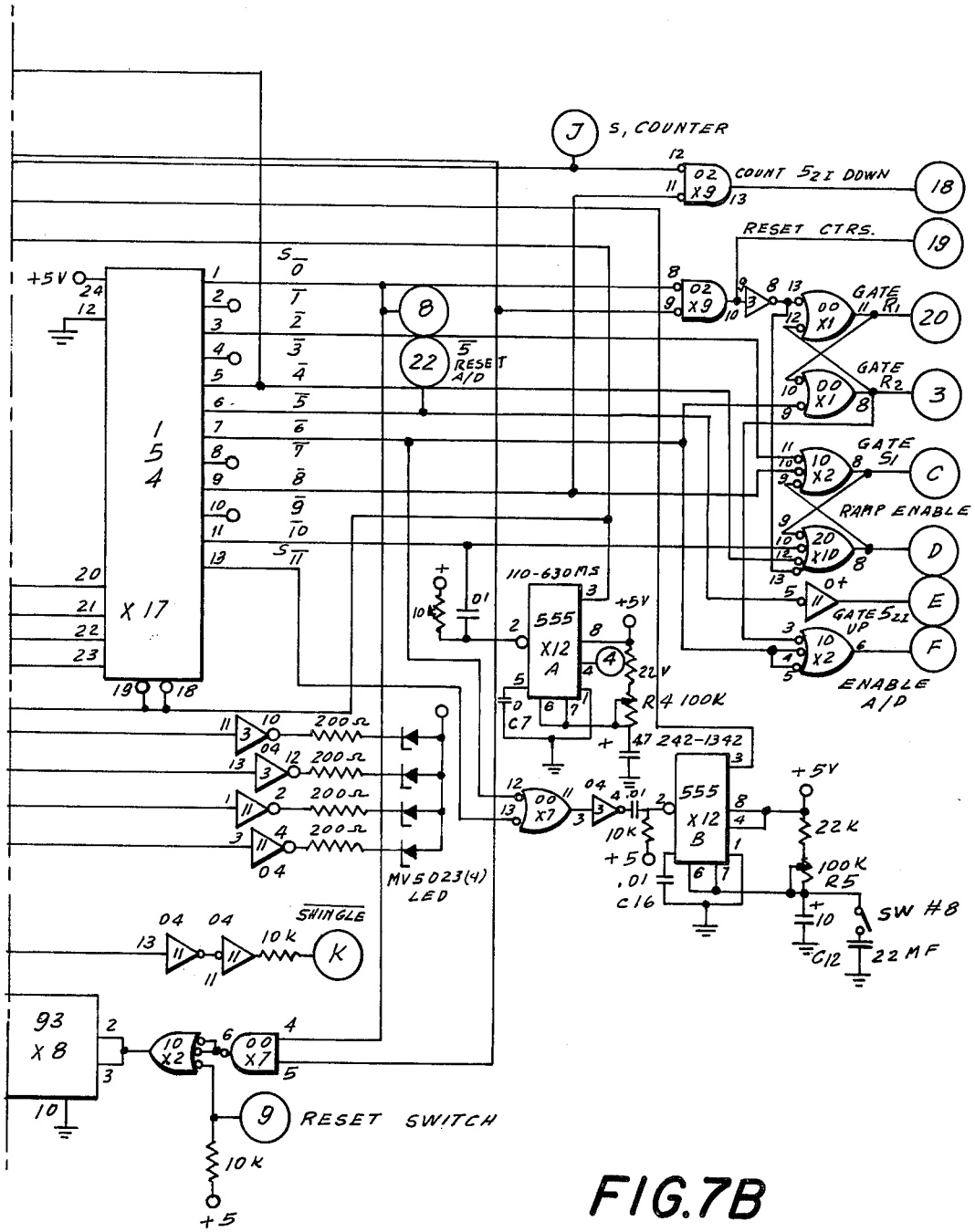

The output of this circuit ($S_2$ CALC at pin 15 goes to the $S_2$ INT counter and D/A converter of FIG. 7 where the $S_2$ CALC is rounded to $S_2$ INT. The count $S_2$ INT is also stored there and later counted down to zero to add the desired number of slices.

The $S_2$ INT analog voltage is returned on pin 9 and applied to a second analog multiplier - divider IC chip 76 where the $(S_2 \text{CALC}/S_2 \text{INT}) \times R1 = R2$ computation is performed.

The feed rate ($R_1$) for the first feed is selected by a front panel adjustment 78 called slice thickness and is also applied to the multiplier 76.

The proper feed rate $R_1$ or $R_2$ is selected by control signals at pins 6 and 8. The selected rate appears as an output at pin 7 and is used to control the drive circuitry of feeder motor 77 while bacon is being sliced.

Figure 5:
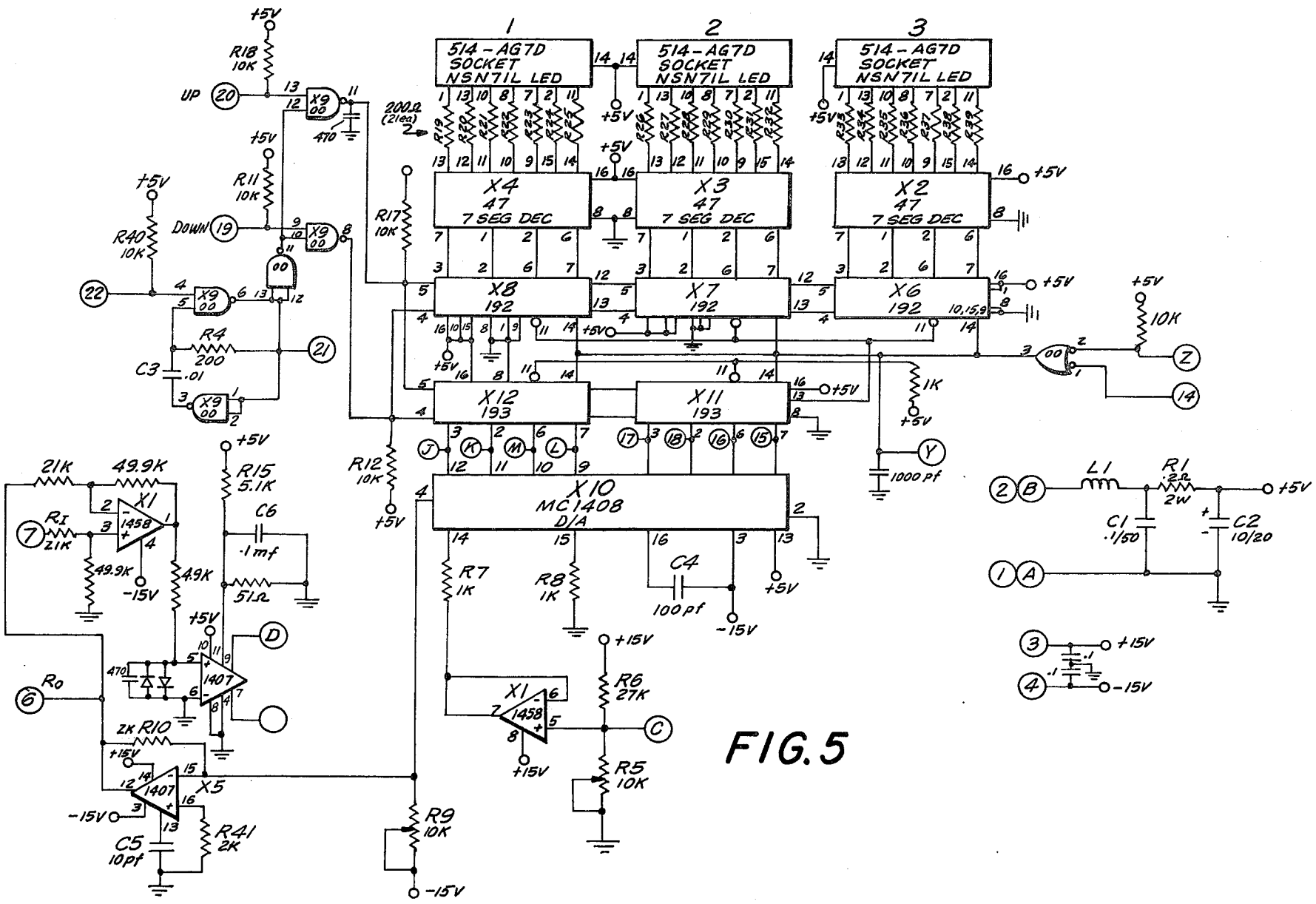
Figure 6:
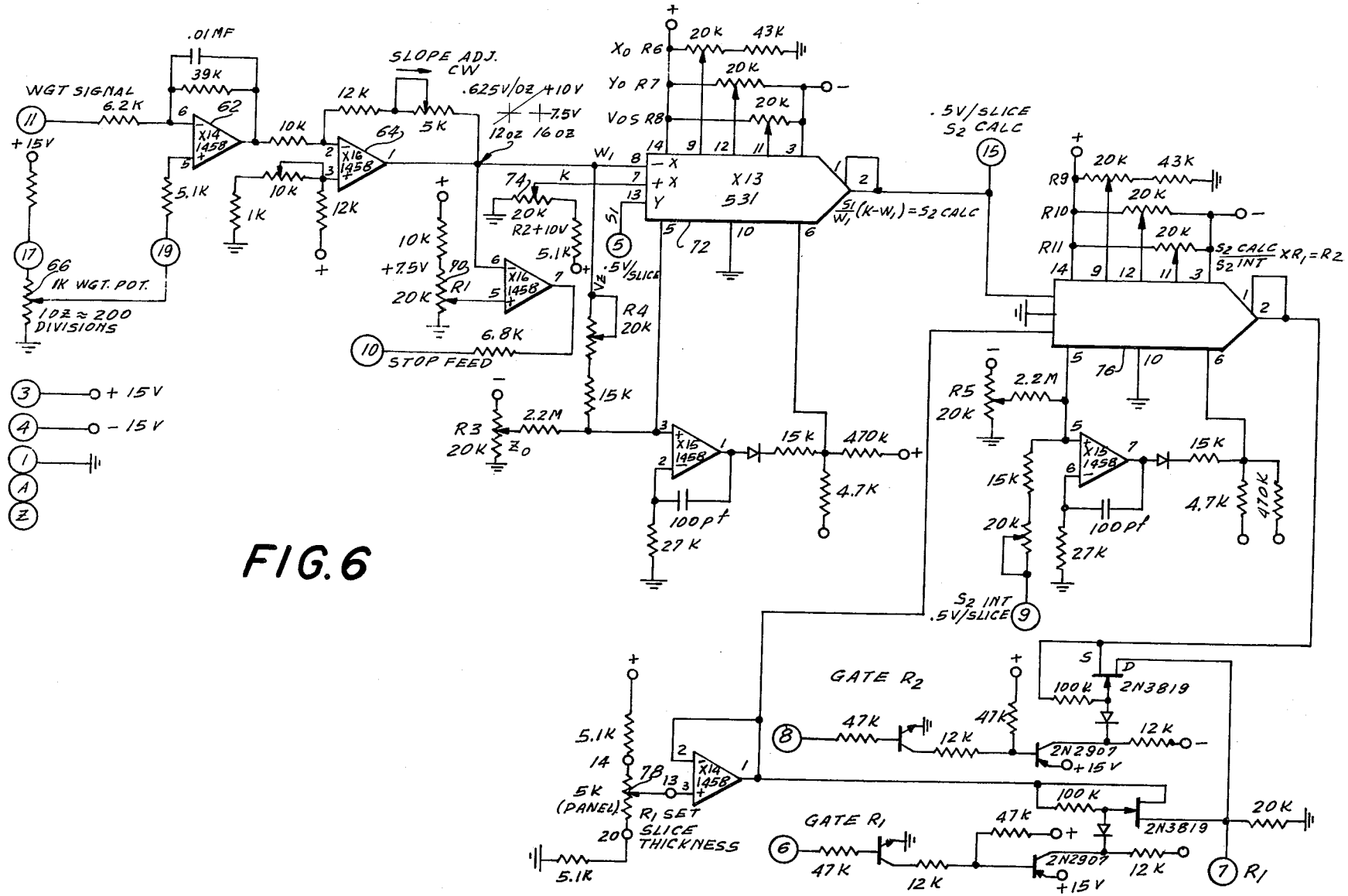

Referring now to FIG. 8, the "$S_2$ CALC" output from the circuitry of FIG. 5 is applied to pin 7. Pins 19, 20 and 22 are held low (OV) until the converter is required to perform its function. When pins 20 and 22 both go high (+4.0V) the count up mode of the converter is enabled and a 100K Hz oscillator 80 (pin 21) produces count up pulses 81.

Integrated circuits 82 and 84 are binary coded decimal (BCD) up down counters and are used with 7 segment LED readouts for displaying the $S_2$ integer value. Integrated circuits 86 and 88 are binary up down counters.

Count up pulses appearing at 81 will cause the $S_2$ counters to count up until the analog output voltage RO (pin 6) equals the nearest integer number of slices to the calculated "$S_2$ CALC." When this occurs, Pin D ($S_2$ INT EOC) will go low (OV), and external circuitry will cause pins 20 and 22 to go low (OV). With pins 20 and 22 both low (OV) the $S_2$ integer value is held in the converter.

During the second feed, the $S_2$ integer counter is counted down to zero by pulses at pin 19 which are produced by the knife synchronization circuitry.

Thus, in operation a bacon belly 18 is fed into the slicing machine 12. The rate of feed of the product 18 is determined by the rate of advance of the conveyor 20 which in turn determines the slice thickness. The slices are placed upon the moving weigh conveyor 44 and when the light group weight is reached as sensed by the scale 42 a signal is generated. The system is set up so that bacon will be sliced at a selected thickness until about ¾ of the package (i.e. 12 oz. for a 1 pound package) has been sliced and then stopped. This signal is transmitted to the network 48 and an appropriate signal is sent to stepper motor 77 to stop the feed pusher 20. After the feed stops, the scale is allowed to settle until a stable weight reading can be obtained. After a predetermined interval, another slicing cycle is started. After the scale 42 senses the weight of the shingled group of slices on conveyor 40, the speed of the conveyor 40 in increased to remove the weighed grouped prior to the initiation of the following slicing cycle.

In the present system the product calculated for add-on during the second feed is calculated directly in number of slices, and is a function of the average slice weight of the first feed. Furthermore, the feed speed of the product for the second feed is automatically adjusted so that an integer number of full slices (no partial slices are added to make the required package weight). In this connection, the second feed is distributed over a number of slices which is fixed or adjustable, e.g., four in order to minimize the deviation in slice thickness between the slices of the first and second feed.

The weighed slices are then conveyed to the cardboard dispenser station 34 where they are deposited on a card and then transferred to the check weigher station 36. From the check weigher station 36, the underweighed drafts are rejected at station 38 and then fed to a make weigh station 40. When the proper weight has been added the full draft is conveyed to the packaging machine for final packaging and shipment.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

What is claimed is:

1. A combination slicing and weighing machine comprising:

a slicing machine having a slicing blade and a feed mechanism for feeding products to be sliced with the slicing blade;

receiving and conveying means for receiving the sliced product coming from the slicing machine;

scale means coupled with the receiving and conveying means for weighing the weight of the sliced product, the scale means being so constructed and arranged to weigh the sliced product at an initial lighter group weight below a heavier draft target weight;

first control means for interrupting the operation of the feeding mechanism when the scale registers the initial group weight and when a draft has been completed;

means for counting the number of slices in the group of sliced product and particularly the number of slices in the lighter group and to be added to reach the heavier draft target weight;

second control means for determining the rate of advance of said feeding mechanism towards such slicing blade and, consequently, the sliced thickness, said second control means feeding the product at a first feed rate and a second feed rate;

calculating means for subtracting the weight of the initial lighter group from the heavier target weight, and multiplying the weight difference by the ratio of the slices in the initial lighter group to the weight of this group to determine the number of slices to be added to produce the heavier draft target weight without changing the slice thickness;

means for calculating the number of slices required to be added for the heavier draft target weight rounded off to the nearest whole integer; and means for correcting the weight error produced by rounding off to the nearest whole integer by multiplying the first feed rate by the ratio of the number of slices calculated to produce the target weight by the number of slices rounded off to the nearest integer to provide a new second feed rate which will produce a whole number of slices at the thickness to produce the draft target weight.

2. The invention in accordance with claim 1, wherein the calculated number of slices to be added to reach the draft target weight and the new second feed rate of the feeding mechanism of the slicing machine are computed by an analog computer circuit and is coupled between the scale means and the second control means.

3. The invention in accordance with claim 2, wherein the second control means includes a stepper motor.

4. The invention in accordance with claim 2, wherein the means computing the nearest whole integer of the number of slices to be added to reach the draft target weight is computed by analog digital-digital analog converter circuitry.

5. The invention in accordance with claim 1, wherein a cardboard dispenser is at the trailing end of the receiving and conveying means for cooperating and placing the group of slices on a card for subsequent packaging.

6. The invention in accordance with claim 5, wherein a check weigher is interconnected by a conveyor with the cardboard dispenser for checking the weight of the group of slices on the card received from the dispenser and rejection means coupled with the check weigher to segregate carded groups which are not at the proper weight.

7. The invention in accordance with claim 6, wherein reject conveyor means is interconnected with the check weigher to receive rejected carded groups of slices and transfer the groups to a make weight station where the proper number of slices are added to produce the desired draft target weight, and means for transferring the correctly weighed drafts from the make weight station to the packaging location.

8. A combination slicing and weighing machine comprising:

a slicing machine having a slicing blade and a feed mechanism for feeding products to be sliced with the slicing blade;

receiving and conveying means for receiving the sliced product coming from the slicing machine;

scale means coupled with the receiving and conveying means for weighing the weight of the sliced product, the scale means being so constructed and arranged to weigh the sliced product at an initial lighter group weight below a heavier draft target weight;

first control means for interrupting the operation of the feeding mechanism when the scale registers the initial group weight and when a draft has been completed;

means for counting the number of slices in the group of sliced product and particularly the number of slices in the lighter group and to be added to reach the heavier draft target weight;

second control means for determining the rate of advance of said feeding mechanism towards such slicing blade and, consequently, the sliced thickness, and second control means feeding the product at a first feed rate and a second feed rate;

calculating means for subtracting the weight of the initial lighter group from the heavier target weight, and multiplying the weight difference by the ratio of the slices in the initial lighter group to the weight of this group to determine the number of slices to be added to produce the heavier draft target weight.

9. The invention in accordance with claim 8, wherein the calculating means includes means for determining the number of slices to be added for the heavier draft target weight rounded off to the nearest whole integer.

10. The invention in accordance with claim 9, including means for correcting the weight error by providing a new second feed rate which will produce a prescribed number of slices that will produce the target weight of the drafts.

* * * * *